United States Patent [19]

Dawkins et al.

[11] Patent Number: 4,722,254

[45] Date of Patent: Feb. 2, 1988

[54] QUICK RELEASE WRENCH

[76] Inventors: Bobby L. Dawkins, 106 Phueler; James R. Rothwell, 6504 Teletha La., both of Chattanooga, Tenn. 37415

[21] Appl. No.: 369,602

[22] Filed: Apr. 19, 1982

Related U.S. Application Data

[63] Continuation-in-part of Ser. No. 317,478, Nov. 12, 1981, abandoned, and a continuation-in-part of Ser. No. 341,592, Jan. 22, 1982, abandoned.

[51] Int. Cl.[4] ..... B25B 13/14

[52] U.S. Cl. ..... 81/145; 81/134

[58] Field of Search ..... 81/142, 145, 134, 143, 81/144, 165

[56] References Cited

U.S. PATENT DOCUMENTS

| | | | |
|---|---|---|---|
| 1,317,546 | 9/1919 | Bryant | 81/145 X |
| 1,375,071 | 4/1921 | Apfeld | 81/145 UX |
| 1,471,413 | 10/1923 | Palmeter | 81/145 |
| 1,721,118 | 7/1929 | Hoppner | 81/145 |
| 1,999,076 | 4/1935 | Bauman et al. | 81/145 X |
| 2,253,895 | 8/1941 | Denovich | 81/142 X |
| 2,582,591 | 1/1952 | Hicks et al. | 81/145 |
| 2,850,932 | 9/1958 | Bonkowski | 81/145 |
| 3,996,820 | 12/1976 | Tuell | 81/145 |

*Primary Examiner*—Debra Meislin

*Attorney, Agent, or Firm*—Parkhurst & Oliff

[57] ABSTRACT

An adjustable open-end wrench having an elongated body member, one end of which is a handle, and the other end of which includes a fixed jaw portion and jaw-base portion having a reentrant groove therein with a movable jaw member slidably mounted in the reentrant groove and a rack portion on the bottom of the movable jaw member for interaction with a second rack member located in another chamber in the body member located just below the reentrant groove, that chamber also housing the interior end of a button member which extends to the exterior edge of the wrench body member, and a lever member and biasing means for biasing the button member outwardly while biasing the rack members into engagement with each other. By simply pushing the exposed portion of the button member, the movable jaw is released for slidable adjustment of the width of the open-end wrench opening.

3 Claims, 10 Drawing Figures

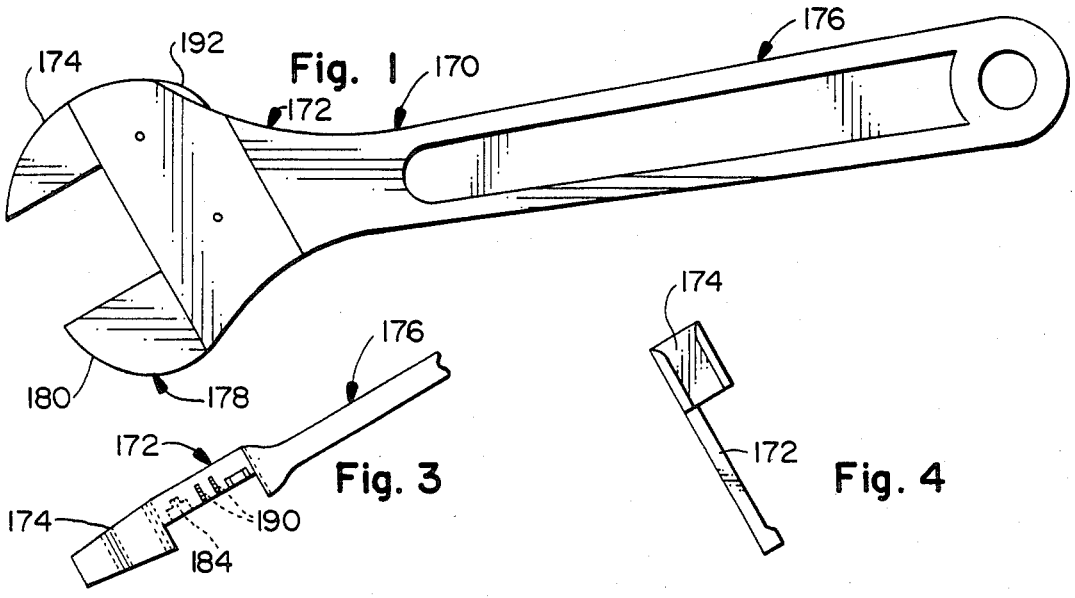
Fig. 1
Fig. 3
Fig. 4
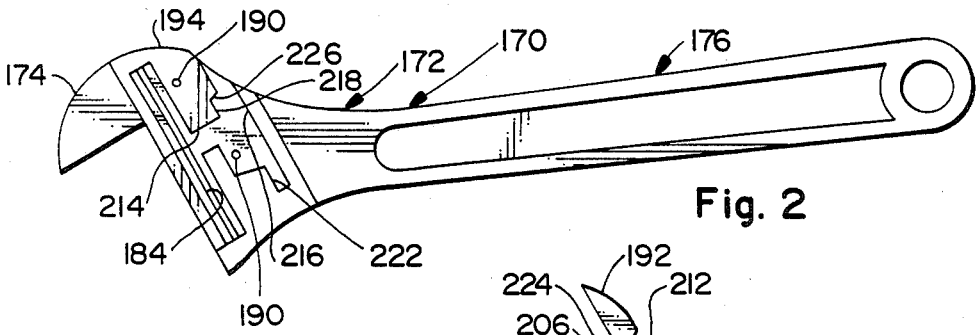
Fig. 2
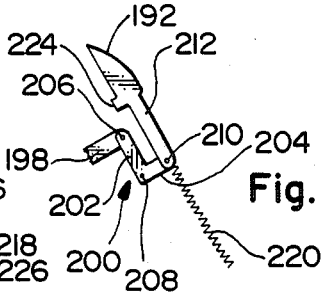
Fig. 9
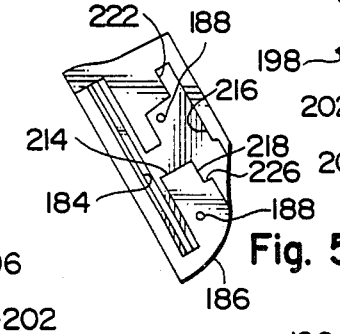
Fig. 5
Fig. 10
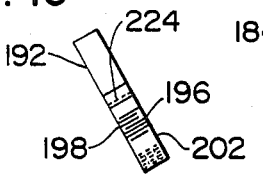
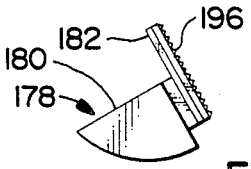
Fig. 6
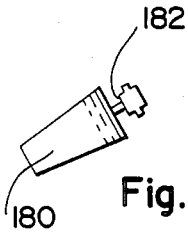
Fig. 8
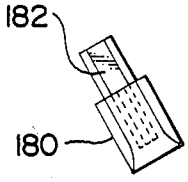
Fig. 7

QUICK RELEASE WRENCH

This invention is a continuation-in-part of U.S. patent application Ser. No. 317,478 filed 12 Nov 81 now abandoned, and U.S. patent application Ser. No. 341,592 filed 22 Jan 82, now abandoned.

BACKGROUND OF THE INVENTION

This invention relates to wrenches and, more particularly, to a wrench having a quick release feature.

Wrenches are constructed of a pair of jaws joined by a mechanism capable of drawing the jaws together for secure engagement with an object which is to be grabbed by the wrench, and separating the jaws for releasing the object. In one common form of wrench, a jaw extends transversely of an elongated arm having a set of teeth arranged serially along the arm by which the jaw may be adjustably located relative to the other jaw at a desired position. In the case of a pipe wrench, the foregoing mechanism must be so structured so as to permit a pivoting between the jaws whereby the jaws are tightened onto a pipe by the pivoting action.

A problem arises in the case of a wrench, such as a pipe wrench, when it is desired to disengage the wrench from the pipe since such disengagement often requires both hands, and in circumstances where the work area is crowded so as to militate against the use of both hands. In spite of the long felt need for an adjustable wrench having such disengagement feature, and in spite of the variety of wrench mechanisms providing a variety of features, no mechanism has heretofore permitted single-handed disengagement of such wrenches without an auxiliary aid, manual or physical, to hold a pipe or other object steady.

SUMMARY OF THE INVENTION

The foregoing problem is overcome and other advantages are provided by a wrench having, in accordance with the invention, a push button release in a mechanical structure.

A spring urges a fixture, with a rack supported thereon, towards the arm of a movable jaw assembly for engagement of the teeth of the rack with the teeth of the arm. Thus, the spring engages the teeth to permit operation of the jaws. The push button is located for opposing the force of the spring. Thus, upon manual activation of the push button, the fixture with the rack is urged away from the arm for disengagement of the teeth so as to release the grip of the jaws. During the disengaged state of the teeth, the neck assembly freely slides within the body assembly and, therefore, permits a simple manual adjustment of the jaw spacing by only one hand. Such adjustment of the jaw spacing may be either an opening of the jaws for releasing the wrench from the workpiece, or a closing of the jaws for engagement of the wrench with the workpiece. Thereby, the invention provides for the one-handed releasing of the grip of a wrench.

BRIEF DESCRIPTION OF THE DRAWINGS

The foregoing features and other aspects of the invention are explained in the following description taken in connection with the accompanying drawings wherein:

FIG. 1 is an elevation view of an embodiment of the adjustable open-end wrench of the invention wherein the teeth are located on the back side of a movable jaw assembly to permit use of a push button for releasing the grip of the wrench;

FIGS. 2–4 are, respectively, side, top and front views of the main body of the wrench of FIG. 1;

FIG. 5 is an elevation view of a side plate of the body of FIG. 2, the view of FIG. 5 being reversed to show the internal structure thereof;

FIGS. 6–8 are, respectively, side, front and top views of a neck portion, incorporating a jaw to be movably supported within the main body of FIG. 1; and FIGS. 9 and 10 are, respectively, side and front views of a rack assembly for releasably engaging the neck of FIG. 6 to the main body of FIG. 7.

DESCRIPTION OF THE PREFERRED EMBODIMENT

Referring now to FIGS. 1–10, there is shown the preferred embodiment of the adjustable open end wrench, in accordance with the invention, wherein the teeth of the neck or movable jaw portion of the wrench are located on the back side to permit engagement of a rack therewith by use of a pivotable link (FIG. 9). The pivotable link connects with a slidable thumb pad or push button member whereby an operator of the wrench can conveniently disengage the grip of the wrench by the sliding of the pad by his thumb or finger.

As shown in the figures, the wrench 170 includes a main body 172 comprising a fixed jaw 174 at one end with a handle 176 extending at the opposite end. A movable jaw portion in the form of a neck 178 has a jaw 180 extending transversely from an arm 182 as shown in FIG. 5. The arm 182 is slidably supported within a slide 184 formed as a re-entrant channel within the main body 172 and extending into a side plate 186. The plate 186 is secured by screws (not shown) to be set within holes 188 and 190 of the plate 186 and the body 172.

In accordance with a feature of the invention, a thumb pad 192 is slidably mounted along the back of a head 194 of the body 172 near the base of the handle 176 to permit convenient operation by the thumb or other finger of the operator of the wrench 170 for one-handed disengagement of the grip of the wrench 170. Teeth 196 are integrally formed within the neck or movable jaw 178 and disposed along the back side thereof for releasable engagement with the teeth of a rack 198.

Connection between the rack 198 and the pad 192 is provided by a link 200 comprising two integrally formed legs 202 and 204 disposed perpendicularly to each other as shown in FIG. 9. Three pivots 206, 208 and 210 are employed with the link 200, the pivot 206 connecting the leg 202 with the rack 198, the pivot 208 connecting the link 200 with the main body 172, and the pivot 210 connecting the leg 204 with a strut 212 upon which the pad or button member 192 is mounted.

The rack 198 is slidably mounted within a guide 214 extending between the channel of the slide 184 and a chamber 216 formed within the body 172 and the plate 186. The link 200 sits within the chamber 216. The strut 212 sits within an open-ended passage 218 of the chamber 216. A spring 220 sits within a blind passage 222 of the chamber 216, and pushes against the end of the passage 222 to exert a force against the strut 212 and the leg 204. Thereby, the spring 220 urges the link 200 to pivot and drive the rack 198 against the arm 182 for securing the neck 178 within the body 172. Also, the foregoing pivoting of the link 200 moves the strut 212 to extend the push button 192 beyond the surface of the body 172. A tang 224 of the push button 192 engages a corner 226 of the passage 218 to serve as a stop to movement of the button 192.

In operation, the push button 192 is depressed to rotate the link 200 against the force of the spring 220 to retract the rack 198 from engagement with the teeth 196 of the neck of movable jaw 178, thereby freeing the jaw 180 so that it can be moved toward the fixed jaw 174 for gripping an object to be held by the wrench 170. Upon release of the button 192, the spring 220 rotates the link 200 to drive the rack 198 into engagement with the teeth 196 to secure the position of the jaw 180 relative to the jaw 174 for maintaining the grip on the object, as for the tightening of a nut on a bolt (not shown). To release the grip, the button 192 is again depressed for rotation of the link 200 to retract the rack 198 from the neck 178. Thus, the wrench 170 can be operated by one finger, with a convenient motion of the pushing of the button 192 into the back surface of the head 194 of the main body 172.

It is to be understood that the above described embodiment of the invention is illustrative only and that modifications thereof may occur to those skilled in the art. Accordingly, this invention is not to be regarded as limited to the embodiment disclosed herein, but is to be limited only as defined by the appended claims.

We claim:

1. An adjustable open-end wrench, comprising:

an elongated body member terminating at one end in an handle portion, and having at its other end a fixed jaw portion and jaw-base, said body member also having in said jaw-base an elongate, reentrant groove extending substantially normal to the jaw face of the jaw portion and generally transverse to the axis of the handle portion of said elongate body member, and further having another chamber intersecting approximately the center of the bottom of the reentrant groove and emerging on the exterior of one edge of the wrench body for housing an adjustment permitting push button;

a movable jaw member slidably mounted in said reentrant groove in the body member and one end of said movable jaw member being in the form of a second jaw facing the jaw portion of said body member for grasping an object to be held or turned by the wrench, the movable jaw member having a rack of teeth along the surface thereof facing the bottom of the reentrant groove;

a second rack member located in the portion of said chamber intersecting the bottom of the reentrant groove and opposite the rack of teeth on the movable jaw member, with a second rack of teeth facing the opposite direction from the teeth on the movable jaw member for releasably engaging the teeth on the movable jaw member for locking the jaws in a desired position, a button member having a push button portion extending out of said chamber at said one edge of the wrench body, said button member also extending into said chamber substantially parallel to the reentrant groove for slidable movement substantially parallel to the reentrant groove;

a lever member pivotally mounted within said chamber and pivotally connected to the second rack member and the button member for disengaging said second rack portion from said rack of teeth on the movable jaw member, thereby permitting the movable jaw member to slide in said reentrant groove for adjusting the distance between said jaws;

and a single means for biasing said button member outwardly toward the exterior edge of the wrench body and said second rack member toward the rack portion of the movable jaw member.

2. The wrench of claim 1 wherein the wrench body additionally comprises a cover piece for enclosing the reentrant groove and chamber and thus forming part of one side face of the wrench body.

3. The wrench of claim 2 wherein the ends of the reentrant groove do not open through the outside edges of the wrench body.

* * * * *